US011459990B2

(12) United States Patent
Meldolesi et al.

(10) Patent No.: US 11,459,990 B2
(45) Date of Patent: Oct. 4, 2022

(54) INJECTOR APPARATUS

(71) Applicant: RKLAB AG, Root (CH)

(72) Inventors: Riccardo Meldolesi, Shoreham-by-Sea (GB); Ron Kuckler, Root (CH); Daniel Eastwood, Shoreham-by-Sea (GB); Mike Cranfield, Shoreham-by-Sea (GB); Mark Clements, Shoreham-by-Sea (GB); Anthony Perkins, Shoreham-by-Sea (GB)

(73) Assignee: RKLAB AG, Root (CH)

( * ) Notice: Subject to any disclaimer, the term of this patent is extended or adjusted under 35 U.S.C. 154(b) by 93 days.

(21) Appl. No.: 17/254,028

(22) PCT Filed: May 30, 2019

(86) PCT No.: PCT/EP2019/064133
§ 371 (c)(1),
(2) Date: Dec. 18, 2020

(87) PCT Pub. No.: WO2019/243020
PCT Pub. Date: Dec. 26, 2019

(65) Prior Publication Data

US 2021/0262427 A1 Aug. 26, 2021

(30) Foreign Application Priority Data

Jun. 19, 2018 (GB) ..... 1810056

(51) Int. Cl.
*F02M 61/18* (2006.01)
*F02M 51/06* (2006.01)
(Continued)

(52) U.S. Cl.
CPC ..... *F02M 61/188* (2013.01); *F02M 51/061* (2013.01); *F02M 61/042* (2013.01);
(Continued)

(58) Field of Classification Search
CPC .... F02M 61/188; F02M 61/042; F02M 61/08; F02M 61/1813; F02M 61/184;
(Continued)

(56) References Cited

U.S. PATENT DOCUMENTS 1,536,931 A 5/1925 Robbins
2,612,408 A 9/1952 Kurata
(Continued)

FOREIGN PATENT DOCUMENTS

DE 0365751 C 12/1922
DE 19939422 A1 3/2001
(Continued)

OTHER PUBLICATIONS

International Search Report and Written Opinion of the International Searching Authority issued in PCT/EP2019/064133, dated Nov. 6, 2019; ISA/EP.
(Continued)

*Primary Examiner* — Hai H Huynh
(74) *Attorney, Agent, or Firm* — Harness, Dickey & Pierce, P.L.C.

(57) ABSTRACT

An injector nozzle having a first part having a stem and a flange, the flange having a flange surface, a body including a wall defining a hole, an annular nozzle ring having a first surface and a second surface wherein the first surface and/or the flange surface include a plurality of grooves, the stem being received in the hole, the first part being secured to the body to secure the nozzle ring in place such that the first surface engages the flange surface, the second surface engages the body, and the plurality of grooves define a plurality of injector holes.

20 Claims, 13 Drawing Sheets

Figure 1:
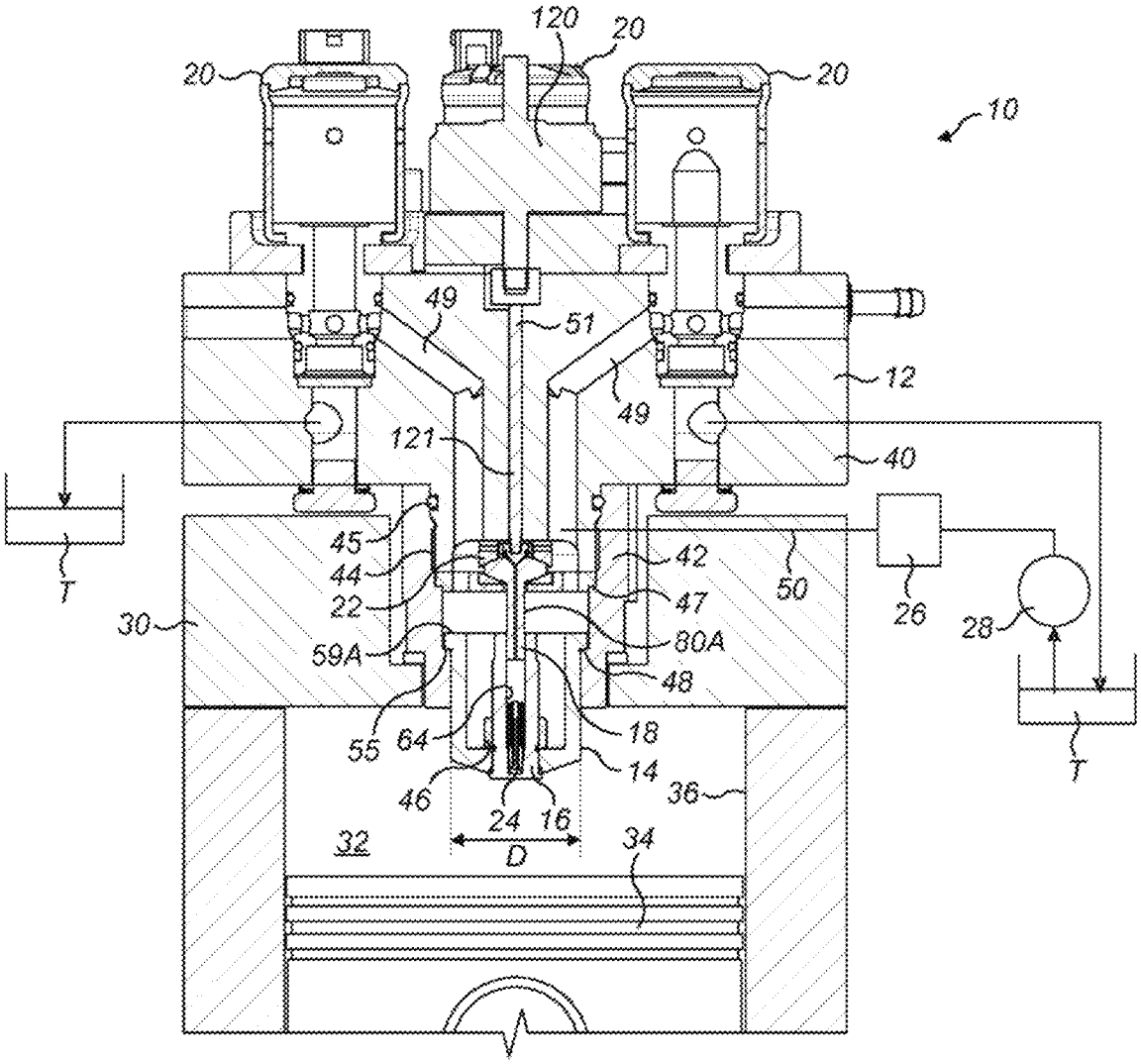

(51) Int. Cl.
*F02M 61/04* (2006.01)
*F02M 61/08* (2006.01)

(52) U.S. Cl.
CPC ..... *F02M 61/08* (2013.01); *F02M 61/184* (2013.01); *F02M 61/1813* (2013.01)

(58) Field of Classification Search
CPC ..... F02M 61/1833; F02M 61/18; F02M 61/1846; F02M 61/1873; F02M 61/168; F02M 61/1806; F02M 61/1886; F02M 51/061; F02M 59/105; F02M 63/0005; F02M 63/0054; F02M 57/028; F02M 49/02; F02M 2200/8076; F02M 2200/80; F02M 2200/16; F02M 2700/075; F16K 15/026; F16K 29/00
USPC ..... 123/456, 457, 510, 511
See application file for complete search history.

(56) References Cited

U.S. PATENT DOCUMENTS

| | | | |
|---|---|---|---|
| 2,770,500 | A | 11/1956 | Dickson |
| 2,812,979 | A | 11/1957 | Ziesche et al. |
| 4,247,044 | A | 1/1981 | Smith |
| 4,427,151 | A | 1/1984 | Trenne |
| 4,714,066 | A | 12/1987 | Jordan |
| 4,991,771 | A | 2/1991 | Porchet et al. |
| 5,785,021 | A | 7/1998 | Yudanov et al. |
| 6,619,263 | B1 | 9/2003 | Mahr et al. |
| 2015/0369192 | A1 | 12/2015 | Ge et al. |

FOREIGN PATENT DOCUMENTS

| | | | |
|---|---|---|---|
| DE | 102009000375 | A1 | 8/2009 |
| EP | 0601038 | B1 | 6/1994 |
| EP | 1722154 | A2 | 11/2006 |
| EP | 1892409 | A2 | 2/2008 |
| EP | 3177822 | A2 | 6/2017 |
| GB | 0542371 | A | 1/1942 |
| GB | 2528981 | A | 2/2016 |
| KR | 2008-0045555 | A | 5/2008 |

OTHER PUBLICATIONS

Search Report from copending GB Application No. GB1810056.0 dated Dec. 3, 2018.

INJECTOR APPARATUS

This application is a U.S. National Phase application of International Application No. PCT/EP2019/064133, filed on May 30, 2019, which claims priority to British Patent Application No. 1810056.0, filed on Jun. 19, 2018. The entire disclosures of the above applications are expressly incorporated by reference herein.

The present invention relates to an injector nozzle, a method of assembling an injector nozzle, a check valve, an injector apparatus, a method of operating an injector apparatus or a valve arrangement.

The present invention is applicable to fuel injectors used in internal combustion engines.

Fuel injectors used in internal combustion engines include both spark ignition and compression ignition (or diesel) engines generally utilise an external pump for supplying the fuel under sufficient pressure to be injected into the engine cylinder. The timing of the injection point in the engine operating cycle is determined by external controlling of the operation of an injector valve by a mechanical or electrical means. One disadvantage of providing external pumping and the control is the need for the provision of servicing of such external systems.

EP0601038 shows an injecting apparatus.

U.S. Pat. No. 4,427,151 shows an injecting apparatus.

EP3177822 shows an injecting apparatus, the content of which is hereby incorporated by reference.

According to an aspect of the present invention there is provided an injector nozzle having a first part having a stem and a flange, the flange having a flange surface, a body including a wall defining a hole, an annular nozzle ring having a first surface and a second surface, the first surface and/or the flange surface include a plurality of grooves, the stem being received in the hole, the first part being secured to the body to secure the nozzle ring in place such that:— the first surface engages the flange surface, the second surface engages the body, and the plurality of grooves define a plurality of injector holes.

The first surface may be flat or frustoconical.

The second surface may be flat.

The second surface may be frustoconical.

An included angle of the second surface may be between 20° and 160°, preferably between 40° and 80° more preferably between 50° and 70°.

The nozzle ring may have a third surface, the first part being secured to the body to secure the nozzle ring in place such that the third surface engages the stem.

The third surface may be cylindrical.

The first part may be secured to the body so as to cause the first surface to be in pressing engagement with the flange surface, the second surface to be in pressing engagement with the body, and the third surface to be in pressing engagement with the stem.

The second surface may be sealed relative to the body and the third surface may be sealed relative to the stem.

The nozzle ring may include a fourth surface between the first surface and the third surface, the fourth surface being spaced from the stem, preferably the fourth surface may be a frustoconical surface.

According to an aspect of the present invention there is provided a method of assembling an injector nozzle including the steps of providing a first part having a stem and a flange, the flange having a flange surface, providing a second part having a first surface wherein the flange surface and/or the first surface include a plurality of grooves, providing a threaded fastener, the method including engaging the flange surface with the first surface such that the grooves define injector holes, tightening the threaded fastener about an axis such that:— the first surface is pressed into engagement with the flange surface in the direction of the axis whilst ensuring the first surface does not rotate about the axis relative to the flange surface.

The stem may include a threaded portion for receiving the threaded fastener.

The second part may be an annular nozzle ring, the method further including providing a body including a wall defining a hole, the stem being received in the hole, the first part being secured to the body by the threaded fastener to secure the nozzle ring in place.

According to an aspect of the present invention there is provided an injector nozzle including a first part having a first surface and a second part having a second surface, the first surface and/or the second surface including a plurality of grooves, the first surface being engaged with the second surface such that the plurality of grooves define a plurality of injector holes, each injector hole having a cross section area and a length wherein the cross section area varies along the length of the injector hole.

The plurality of injector holes may be at least partially radially orientated and each injector hole has a cross-section area of a radially inner part that is larger than a cross-section area of a radially outer part.

A depth of each groove may vary along the length of the injector hole.

A width of each groove may vary along the length of the injector hole.

According to an aspect of the invention there is provided an injector nozzle for an internal combustion engine having a plurality of injector holes, each injector hole having an inner end and an outer end, a sac volume defined between the inner ends of the injector holes and a check valve of the injector nozzle, each injector hole having a cross-section and a length defined between the inner end and the outer end.

The plurality of injector holes may be at least partially radially orientated and each injector hole has a cross-section area of a radially inner part that is larger than a cross-section area of a radially outer part.

A cross-section of each injector hole may vary along the length of the injector hole.

According to an aspect of the present invention there is provided a check valve having a body with a valve seat and a thread form defining a thread axis, a valve selectively engageable with the valve seat to close the valve and selectively disengageable from the valve seat to open the valve, a bias member for biasing the valve into engagement with the valve seat and a driver rotationally fast with the body and axially moveable relative to the body against the action of the bias member and configured so that rotation of the driver causes rotation of the thread form about thread axis.

The driver may include a bias member seat engaged by the bias member.

Forces from the bias member acting to bias the valve into engagement with the valve seat may be transmitted to the valve via the driver.

The check valve may be a first end defined by the valve seat and a second end.

One or more of the thread form, bias member and driver may be between the first valve seat and the second end.

The body may define a shoulder for sealing the body against a further component, wherein the shoulder may be between the first valve seat and the second end.

The bias member may bias the driver away from the first end.

The valve may include one or more of a piston and a guide.

The piston and/or the guide may be between the first valve seat and the second end.

According to an aspect of the present invention there is provided an injector apparatus for injecting a fluid under pressure into an associated volume, the injector apparatus including:— a body with a first cylinder, a first piston moveable within the first cylinder, thereby defining a control volume, a second piston moveable relative to a second cylinder thereby defining an injector volume, an injector nozzle, the first and second pistons being configured such that movement of the first piston in a first direction under the action of pressure in the associated volume against the first piston causes a reduction in the control volume and a reduction in the injector volume, the apparatus being configured to cause fluid within the injector volume to be injected under pressure through the nozzle into the associated volume when the first piston moves in the first direction, the apparatus including a valve associated with the injector volume to de-pressurise the injector volume and thereby stop injection of fluid into the associated volume.

The valve may be in part defined by a valve seat on the second piston.

The second piston may include a through passage and the valve seat is defined at an end of the through passage.

The second piston may include a first end having a cylindrical wall part moveable within the second cylinder and a second end wherein the through passage extends from the first end to the second end and the second end includes the valve seat.

The valve may include a valve element having a valve surface for selectively engaging the valve seat.

The valve surface of the valve element may be configured to be selectively biased into engagement with the valve seat by an electrically actuated solenoid.

The electrically actuated solenoid may be powered to bias the valve surface into engagement with the valve seat.

The valve element may include a guide wall and second piston includes a guide, the guide wall being slideable within the guide.

The guide wall may be shaped to allow tilting of the valve element relative to the guide, preferably the guide wall may be non-cylindrical, preferably part spherical.

The guide may be defined by a generally cylindrical wall.

The valve element may include an abutment portion, the abutment portion being positioned axially between the valve surface and the guide wall.

The first piston may move in conjunction with the second piston.

The first piston may be fixedly attached to the second piston.

The valve may include a valve surface and a valve seat and the first piston moves relative to the valve surface and valve seat.

According to an aspect of the present invention there is provided a method of operating an injector apparatus for injecting a fluid under pressure into an associated volume, the injector apparatus including:— a body with a first cylinder, a first piston moveable within the first cylinder, thereby defining a control volume, a second piston moveable within a second cylinder thereby defining an injector volume, an injector nozzle, the first and second pistons being configured such that movement of the first piston in a first direction under the action of pressure in the associated volume against the first piston causes a reduction in the control volume and a reduction in the injector volume, the apparatus being configured to cause fluid within the injector volume to be injected under pressure through the nozzle into the associated volume when the first piston moves in the first direction, a supply of pressurised fluid operable to refill the control volume and the injector volume the method including the step of moving the first piston in the first direction to inject fluid under pressure into the associated volume, isolating the control volume and the injector volume from the supply of pressurised fluid, then stopping injection.

The step of isolating the control volume and the injector volume from the supply of pressurised fluid, may occur before the step of injecting fluid under pressure into the associated volume.

According to an aspect of the present invention there is provided an injector apparatus for injecting a fluid under pressure into an associated volume, the injector apparatus including:— a body with a first cylinder, a first piston moveable within the first cylinder, thereby defining a control volume, a second piston moveable within a second cylinder thereby defining an injector volume, an injector nozzle, the first and second pistons being configured such that movement of the first piston in a first direction under the action of pressure in the associated volume against the first piston causes a reduction in the control volume and a reduction in the injector volume, the apparatus being configured to cause fluid within the injector volume to be injected under pressure through the nozzle into the associated volume when the first piston moves in the first direction, wherein a first part of the second piston is moveable within the second cylinder and a second part of the second piston engages a correspondingly-shaped part of the injector apparatus so as to allow alignment of the first part of the second piston with the second cylinder when movement of the first piston in the first direction causes a reduction in the injector volume.

The second part may be curved.

The second part may be generally part spherical.

The correspondingly shaped part of the injector apparatus may move relative to the body.

The second part may have a larger diameter than the first part.

The second part may engage a further correspondingly shaped part of the injector apparatus opposite said correspondingly shaped part of the injector apparatus.

The second part may be curved so as to engage said further correspondingly shaped part of the injector apparatus.

The second part may be generally part spherical to engage said further correspondingly shaped part of the injector apparatus.

The further correspondingly shaped part of the injector apparatus may be moveable relative to the body.

The apparatus may include a valve associated with the injector volume to de-pressurize the injector volume and thereby stop injection of fuel into the associated volume.

The valve may be in part defined by a valve seat on the second piston.

The second piston may include a through passage and the valve seat is defined at an end of the through passage.

According to an aspect of the present invention there is provided a valve arrangement including a valve element having a valve surface for selectively engaging and disengaging a valve seat of the valve arrangement, an abutment for biasing the valve surface into engagement with the valve seat and a guide wall for aligning the valve element in a bore of the valve arrangement, the valve surface and abutment defining an axis, wherein the width of the guide wall perpendicular to the axis is variable to allow tilting of the valve element relative to the bore.

The guide wall may be non-cylindrical.

The guide wall may be part spherical.

The bore may be defined by a generally cylindrical wall.

The valve element may include an abutment portion, the abutment portion being positioned axially between the valve surface and the guide wall.

According to an aspect of the present invention there is provided an injector apparatus for injecting a fluid under pressure into an associated volume, the injector apparatus including:— a body with a first cylinder, a first piston moveable within the first cylinder, thereby defining a control volume, a second piston moveable relative to a second cylinder thereby defining an injector volume, an injector nozzle, the first and second pistons being configured such that movement of the first piston in a first direction under the action of pressure in the associated volume against the first piston causes a reduction in the control volume and a reduction in the injector volume, the apparatus being configured to cause fluid within the injector volume to be injected under pressure through the nozzle into the associated volume when the first piston moves in the first direction, the injector nozzle including a check valve and a plurality of injector holes, a sac volume being defined between ends of the injector holes proximate the check valve and the check valve, the check valve having a body defining a valve seat and a valve defining a valve surface for engagement with the valve seat to close the check valve, the valve further including a piston movable within a bore of the body configured to draw fluid into the bore from the sac volume upon closing of the check valve.

The valve may include a valve guide configured to centralize the valve in the bore when the valve is open.

The invention will now be described, by reference to the accompanying drawings in which:—

Figure 5:
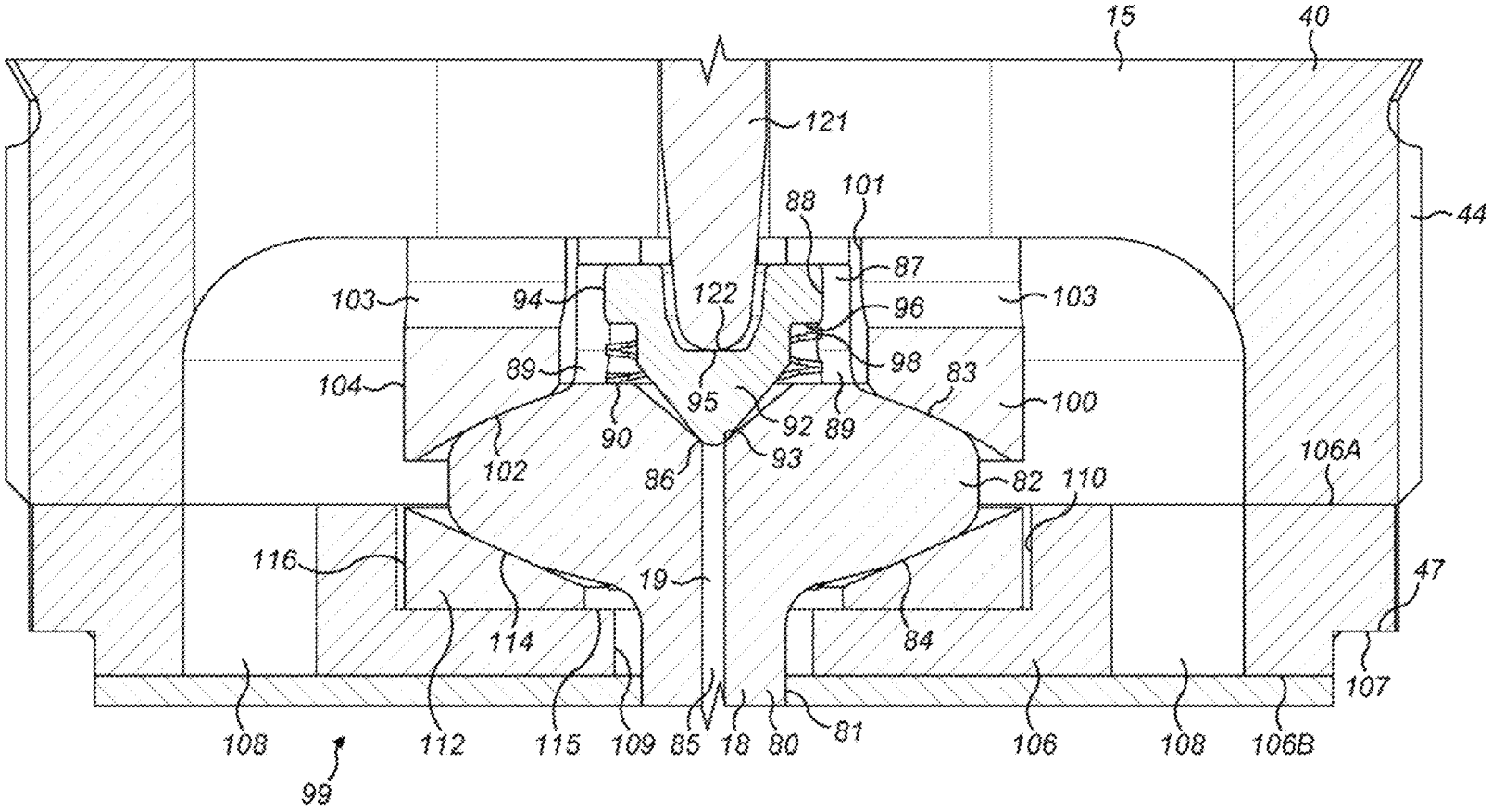
Figure 5C:
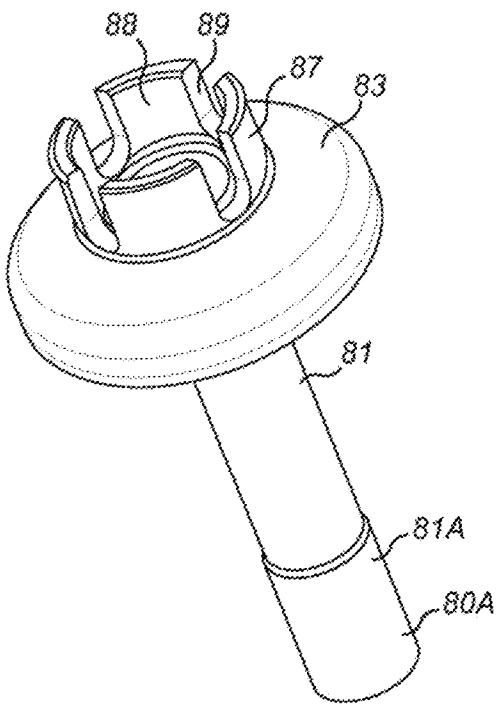
Figure 5B:
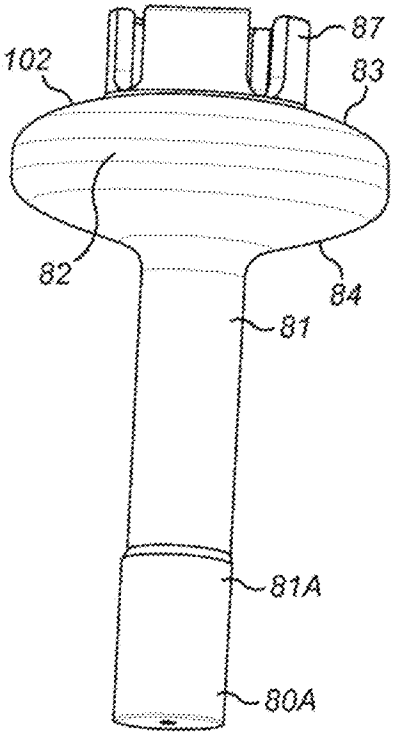
Figure 5A:
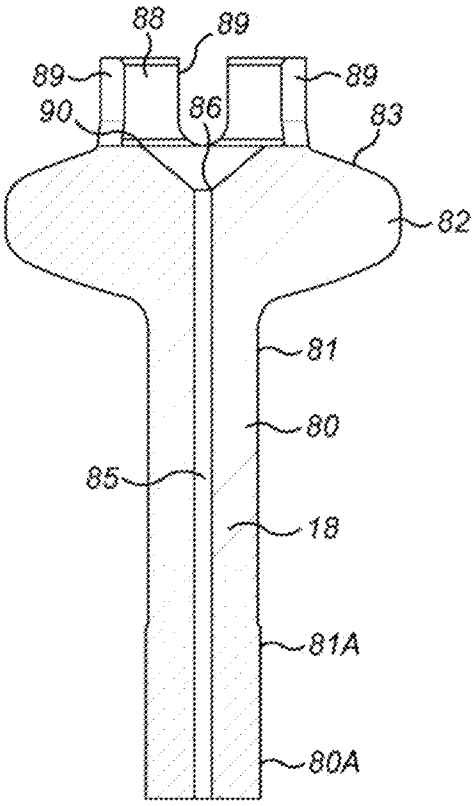
Figure 5D:
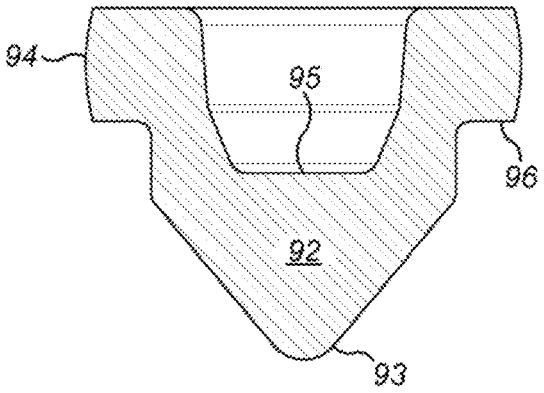
Figure 5E:
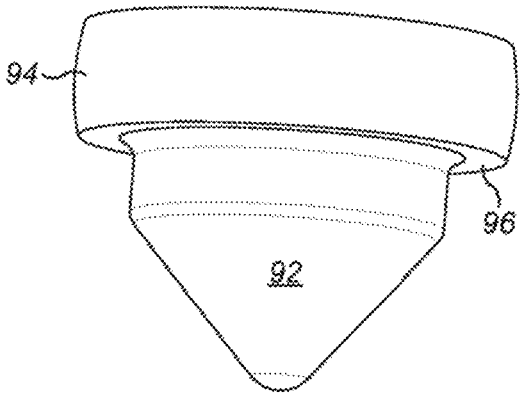
Figure 5F:
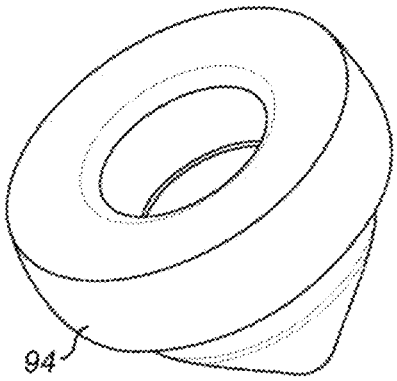
Figure 6:
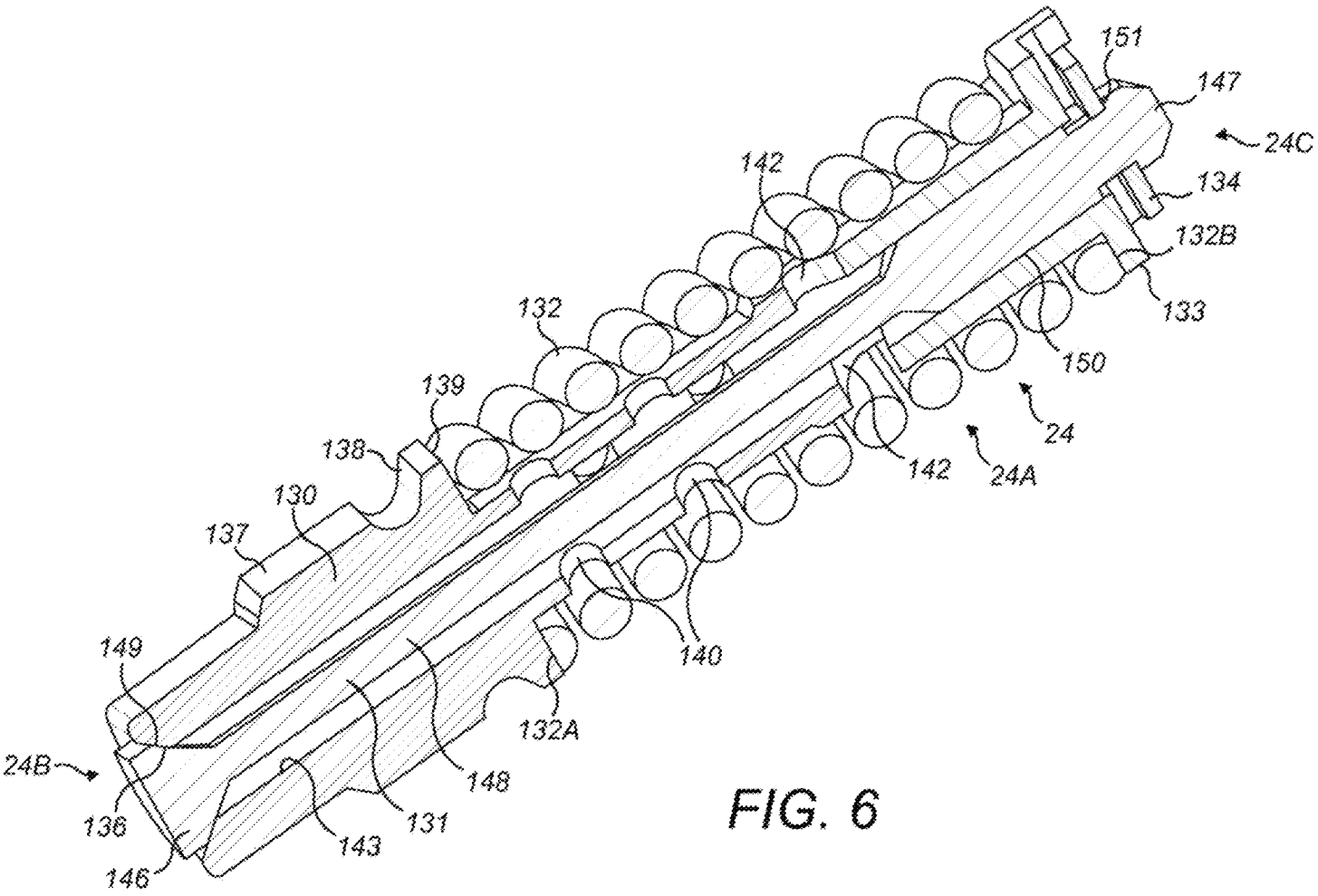
Figure 7:
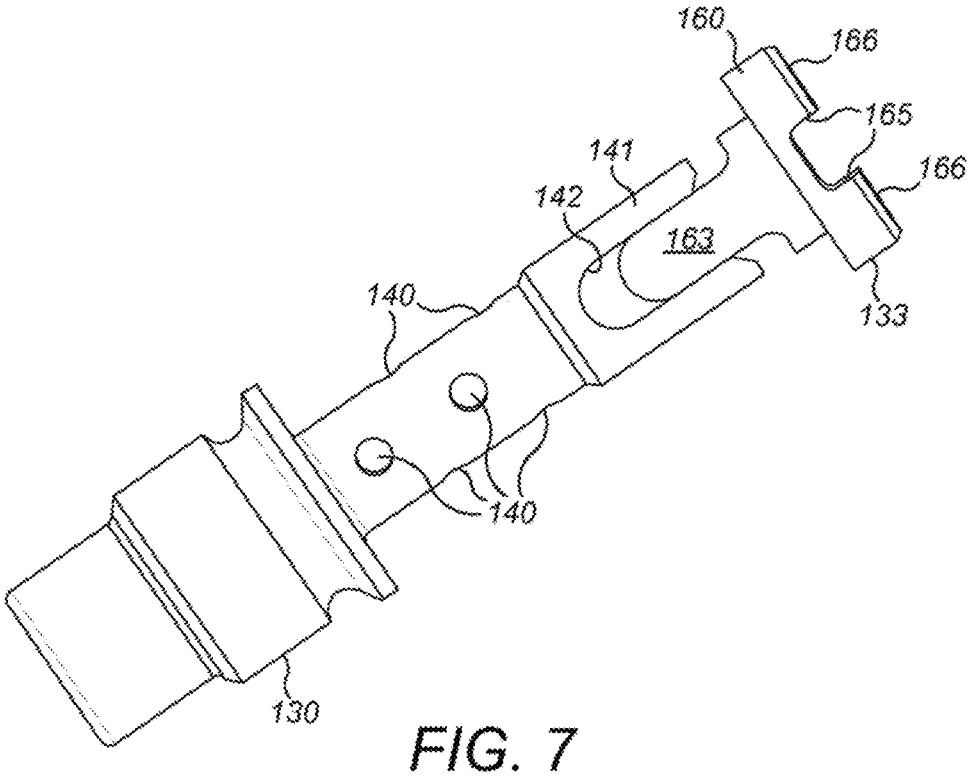
Figure 8:
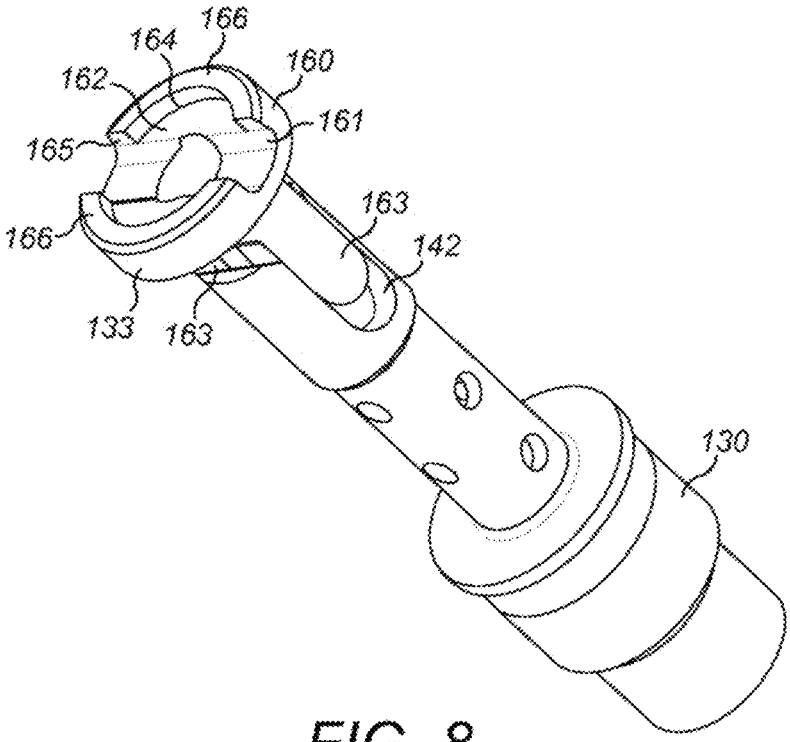
Figure 9:
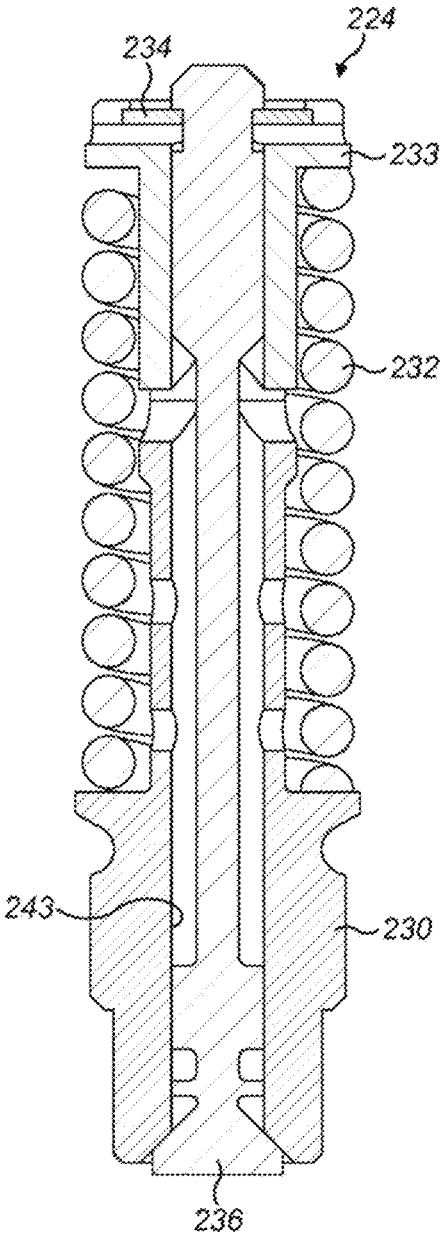
Figure 9A:
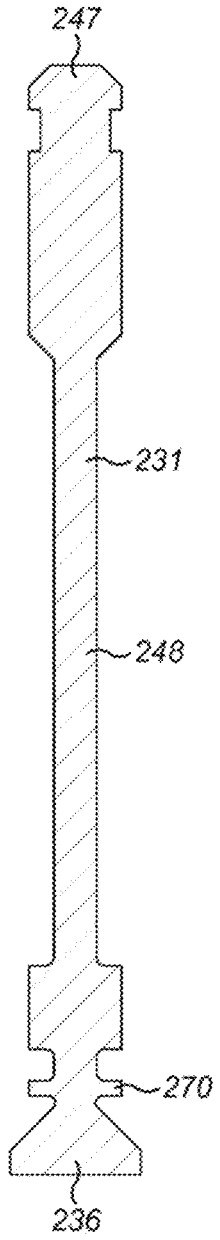
Figure 9B:
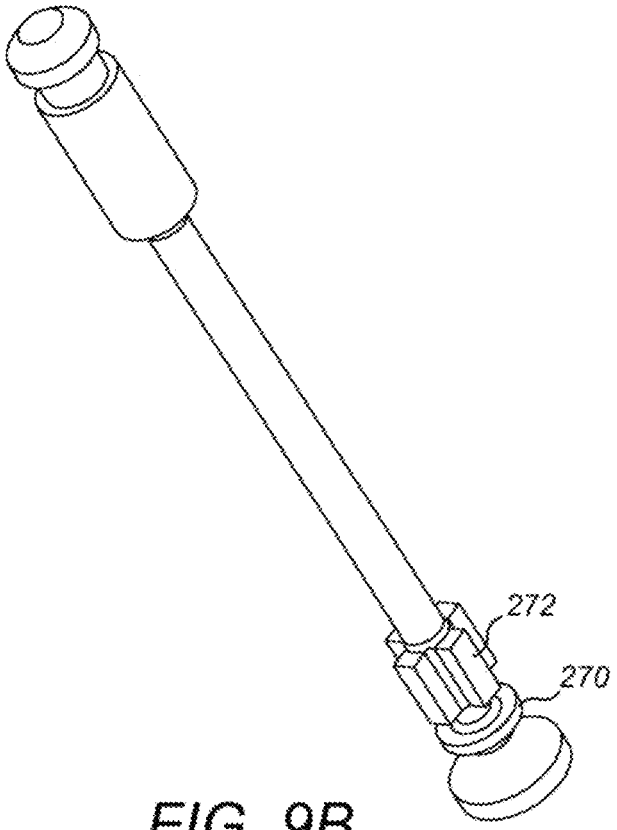
Figure 9C:
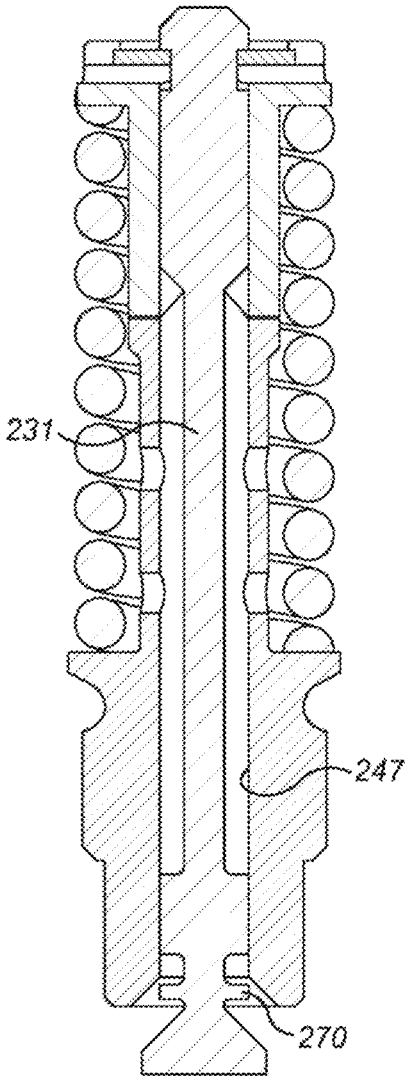
Figure 9D:
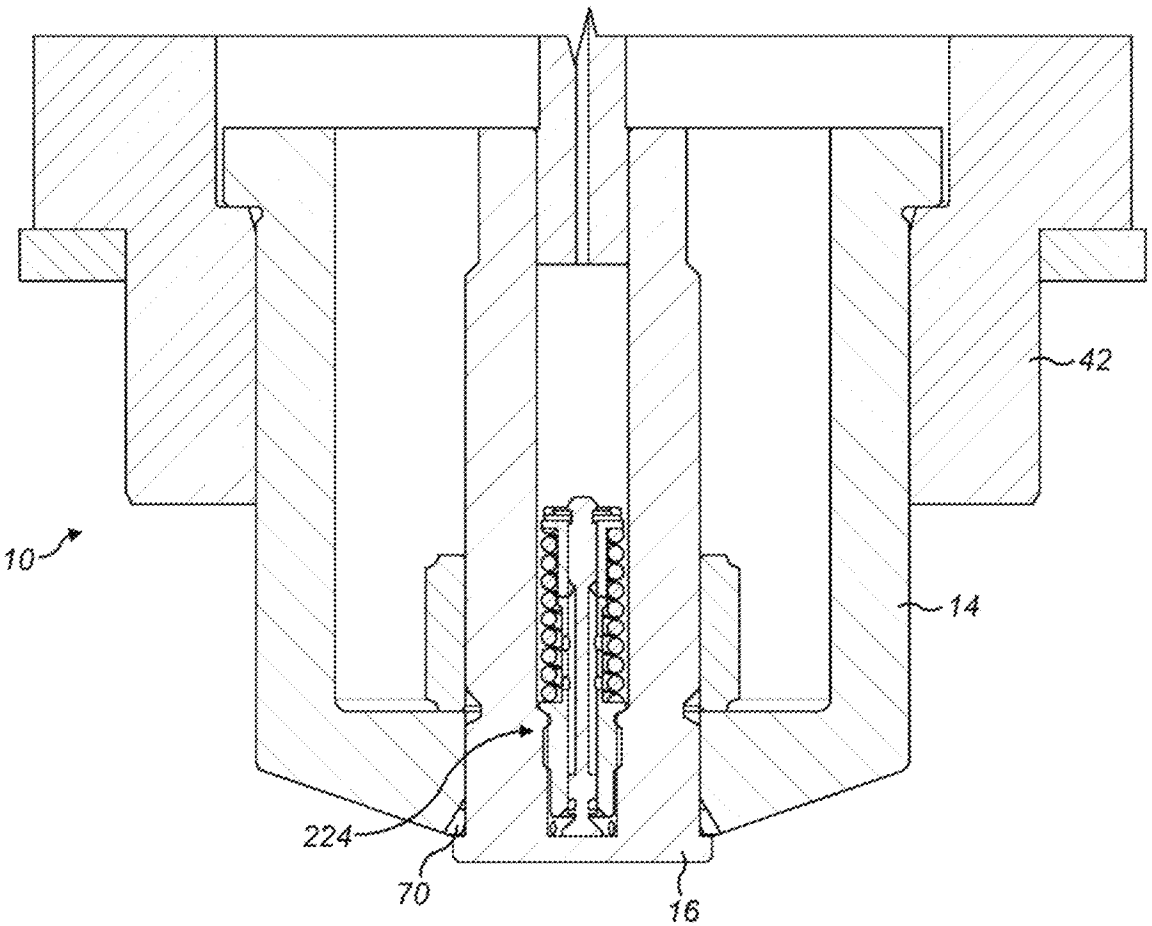
Figure 10:
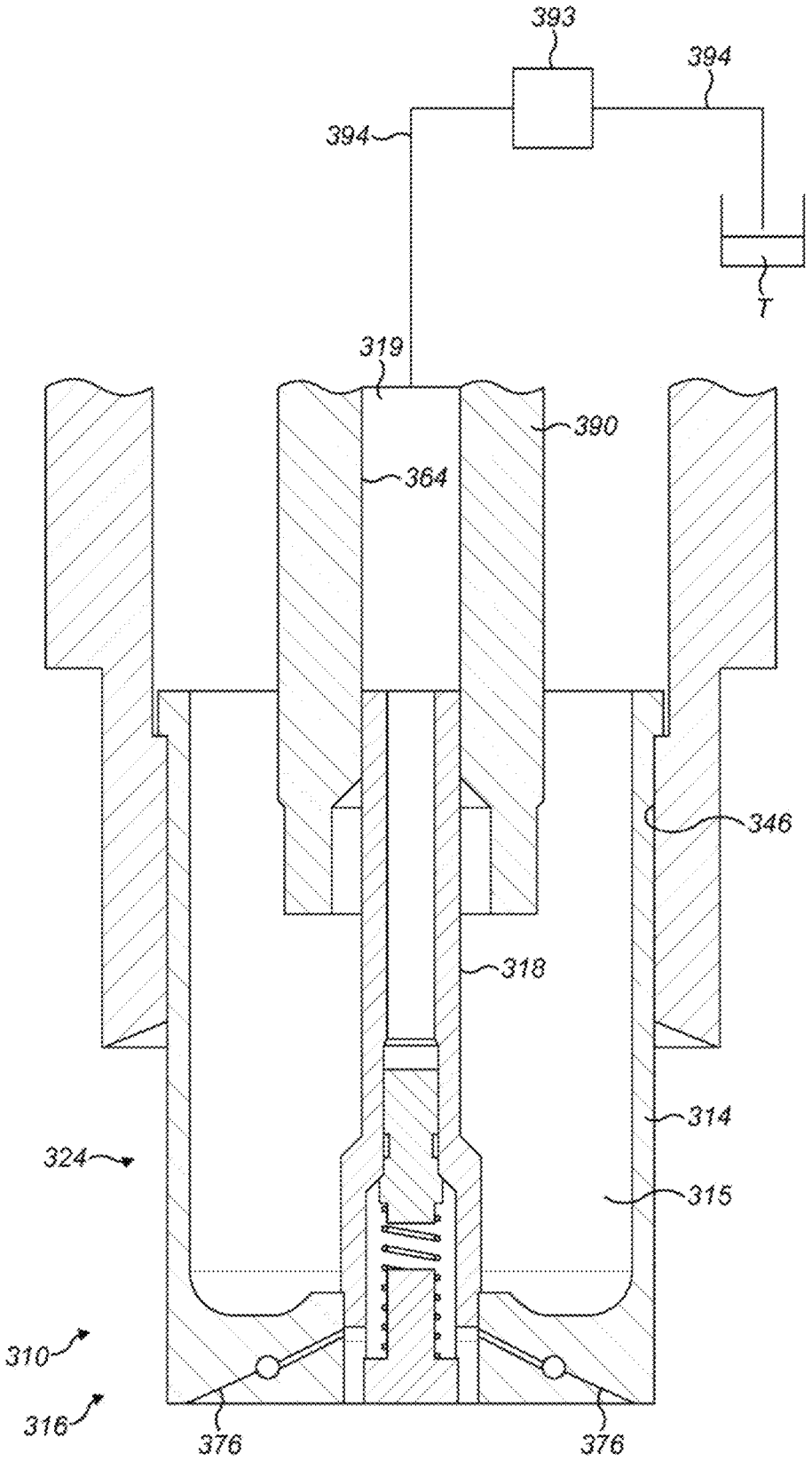

FIG. 1 is a cross-section view of an injector apparatus according to the present invention, FIGS. 2 to 5 are cross-section views of certain components of the injector apparatus of FIG. 1, FIGS. 5A to 5C are various views of the second piston of FIG. 5, FIGS. 5D to 5F are various views of the valve element of FIG. 5, FIG. 6 is a cross-section isometric view of the check valve of FIG. 1, FIGS. 7 and 8 show views of part of the check valve shown in FIG. 1, FIGS. 9 to 9C show various views of an alternative check valve for use in the injector apparatus of FIG. 1, FIG. 9D shows the check valve of FIGS. 9A to 9C installed in an injector apparatus shown in FIG. 1, and FIG. 10 shows a schematic view of parts of an alternative injector apparatus according to the present invention.

With reference to the figures there is shown an injector apparatus 10 having a body 12, a first piston 14, an injector nozzle 16, and a second piston 18. The injector apparatus further includes four control volume vent valves 20 (only three of which are shown), an injector volume vent valve 22, a check valve 24 and a supply valve 26 (shown schematically).

In use the injector apparatus is attached to a cylinder head 30 (shown schematically) or the like with the nozzle being configured to inject fluid into an associated volume 32, such as an internal combustion chamber. The associated volume 32 varies as a piston 34 reciprocates within a cylinder 36 of an internal combustion engine 38.

In use, a pump 28 may be connected to a tank T. The tank T may supply fluid to the pump 28 and may also receive fluid from the injector apparatus as will be further described below.

The body 12 has a first part 40 and a second part 42, the second part 42 is secured to the first part 40 via thread 44 and sealed to the first part via O-ring 45. The second part 42 includes a bore 46 having diameter D (in one example D=25 mm). The second part has a shoulder 47 and a shoulder 48. The first part 40 includes four passages 49 (only two of which are shown), each passage being associated with a control volume vent valve 20. First part 40 includes a passage 50 (shown schematically) associated with the supply valve 26. First part 40 also includes a passage 51.

The first piston 14 has a piston wall 54 sized to be a close sliding fit within bore 46. The first piston 14 includes a shoulder 55 and an end wall 56 having a bore 57, the bore 57 having a chamfer 58. The first piston is generally hollow having a recess 59, and an end surface 59A.

The injector nozzle 16 includes a stem 60 having a stem wall 61, sized to be a close fit or a press fit in the bore 57. The stem also has an external thread 62 and a bore 63 having a bore wall 64, an internal thread 65 and a shoulder 66. In one example the bore 63 has a diameter d of 3.5 mm. The bore 63 is smaller than the diameter of the bore 46. The injector nozzle 16 includes an end wall 67 having a flange 68. The flange has a flange surface 68A. Cross-drilling 69 fluidly couple the bore 63 to the stem wall 61 in a region near the flange 68.

The injector nozzle further includes an annular nozzle ring 70 having a first surface 71, a second surface 72 and a third surface 73. The first surface is flat and includes a series of generally radially orientated grooves 74. The second surface 72 is frustoconical. The third surface is cylindrical. The nozzle ring 70 also includes a chamfer 75 between the third surface 73 and the first surface 71.

The second piston 18 includes a stem 80 having a stem wall 81, the lower wall part 81A of which is sized to be a close sliding fit in bore wall 64 of the injector nozzle 16. The stem has an end 80A. The piston 18 includes a head 82 having a surface 83 which is part spherical. On an opposite axial side of head 82 is a further surface 84. The stem and head include a passage 85 terminating at a head end, in a valve seat 86. Projecting upwardly (when viewing FIG. 5) from the head 82 is a cylindrical portion 87 having a bore 88 and slots 89 connecting the outer part of the cylindrical portion 87 with the bore 88. The head 82 defines a spring seat 90.

As best seen in FIG. 5 a valve element 92 includes a valve surface 93 for selectively engaging and disengaging the valve seat 86 of the second piston 18. The valve surface 93 together with valve seat 86 define part of a high pressure valve 99. Valve element 92 also includes a guide wall 94 which is a close sliding fit in bore 88. The guide wall forms part of a sphere. The valve element also includes an abutment 95 and spring seat 96.

A spring 98 engages spring seat 90 and spring seat 98 to bias the valve element 92 away from head 82 as will be further described below.

A head seat element 100 includes a bore 101 and a head seat 102. The head seat 102 is shaped to correspond with the surface 83 of the second piston 18. The head seat element 100 has cross drillings 103 which connect an outer surface 104 of the head seat element with the bore 101.

A plate 106 includes end surface 106A and 106B, a shoulder 107, through holes 108, central hole 109 and recess 110.

Positioned within recess 110 is a second head seat element 112 which is generally annular and has a conical surface 114, a bore 115 and an external wall 116. The external wall 116 is sized to be a loose fit in the recess 110, thereby allowing some lateral movement of the second head seat element 112 relative to the plate 106.

Solenoid 120 is secured to the second part 42 of the body 12 and actuates a rod 121 which is slideable within passage 51. An end 122 of rod 121 engages abutment 95 of the valve element 92 as will be further described below.

The check valve 24 includes body 130, valve 131, resilient element in the form of spring 132, drive element 133 and circlip 134.

The body 130 includes a valve seat 136, an external thread 137, a shoulder 138, a spring seat 139, cross-drillings 140 and head 141. The head 141 is generally cylindrical and includes drive recesses 142. The body 130 includes a central bore 143.

The valve 131 includes a first valve head 146 connected to a second valve head 147 via a stem 148. The first valve head includes a valve surface 149 which selectively engages and disengages the valve seat 136 of the body 130. The second valve head includes a valve wall 150 and a shoulder 151.

The spring 132 is a compression spring and includes a first spring end 132A and a second spring end 132B.

The drive element 133 includes a generally cylindrical head 160 having a cross groove 161, a circlip seat 162. Attached to the head 160 are two drive tangs 163 shaped to slideably engage drive recesses 142 of the body 130. The head 160 includes an upstanding generally cylindrical wall 166. The cross groove 161 defines notches 165 in the wall 166. The wall 166 together with the circlip seat 162 define a recess 164.

Assembly of the check valve 24 is as follows:—

The spring 132 is slid onto the body such that end 132A of the spring engages the spring seat 139 of the body. The valve 131 is inserted into the central bore of the body from the valve seat end of the body until the valve surface 149 of the valve engages the valve seat 136 of the body. The drive element is then slid over the second valve head 147 with the drive tangs of the drive element engaging the drive recesses 142 of the body. The spring is compressed between the drive element and the body such that the circlip can be secured on the second valve head 147 such that it abuts the shoulder 151 of the valve 131. The pressure between the drive element and body is then released allowing the spring to extend slightly until such time as the circlip 134 engages the circlip seat 162 and is contained within the recess 164. The drive element therefore also acts as a spring retainer.

Figure 2:
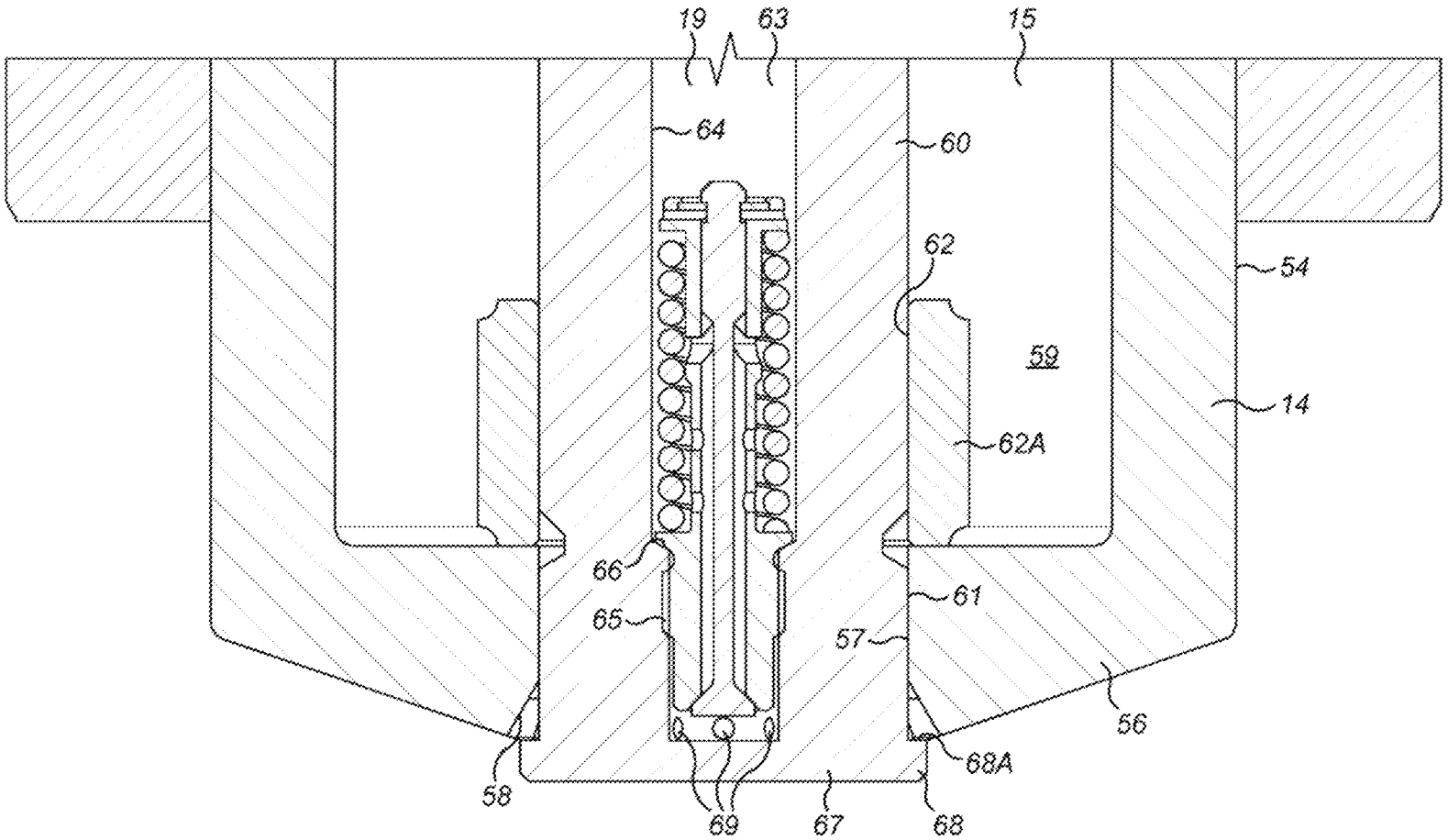

The check valve 24 has a first end 24B and a second end 24C. The valve surface 149 and valve seat 136 are positioned proximate the first end 24B. All other significant features of the check valves such as the external thread 137, the shoulder 138, the spring 132, the drive element 133, the circlip 134, the notches 165 and other components are all positioned between the valve surface 149/valve seat 136 and the second end. Consideration of FIG. 2 shows that by positioning these components nearer the second end allows the valve surface 149/valve seat 136 to be positioned close to the bottom of the bore 163 which minimises the "sac" volume, i.e. the volume between the valve surface 149/valve seat 136 and the radially outer ends 74B of the injector holes 76. The sac volume includes the annular volume having a wedge-shape cross-section defined by chamfer 75 and stem wall 61, the volume of cross-drillings 69 and the volume of the bottom of the bore 63 below the valve surface 49/valve seat 36. It is advantageous to minimise the sac volume since this sac volume is an uncontrolled volume and by designing the check valve as described above, the sac volume is minimised.

Assembly of the various components of the injector apparatus 10 is as follows.

FIG. 6 shows the check valve forming a subassembly 24A. The subassembly 24A is inserted into the bore 63 of the injector nozzle 16 such that the external thread 137 of the body 130 of check valve subassembly 24A engages the internal thread 65 of the injector nozzle 16. Notches 165 of the check valve subassembly 24A allow a twin pronged driving tool (not shown) to rotate the drive element 133. The drive tangs 163 of the drive element 133 in turn rotate the drive recesses 142 which in turn cause the body 130 and hence the external thread 137 to rotate. The drive tool is used to screw the check valve subassembly 24A into the injector nozzle 16 until such time as the shoulder 138 of the body of the check valve engages the shoulder 66 of the injector nozzle 16. Shoulders 138 and 66 are designed to seal the body 130 of the check valve to the injector nozzle 16.

To assemble the injector nozzle 16 (and pre-assembled check valve 24) into the first piston 14, the annular nozzle ring 70 is assembled onto the injector nozzle 16 such that the first surface 171 of the annular nozzle ring engages the flange surface 68A. The stem 60 of the injector nozzle is then inserted through the bore 57 of the first piston 14 such that the stem wall 61 engages the bore 57 and the second surface 72 of the annular nozzle ring engages the chamfer 58 of the first piston. A nut 62A is then threaded onto the external thread 62 of the injector nozzle and tightened. Significantly, during tightening of the nut 62A the injector nozzle is prevented from rotating relative to the first piston 42. By ensuring the nozzle does not rotate relative to the first piston ensures that no relative rotation of the flange surface 68A of the nozzle and the first surface 71 of the annular nozzle ring takes place. This ensures the integrity of the grooves 74 by ensuring they are not "wiped" across flange surface 68A. When the first surface of the nozzle ring is in engagement with the flange surface 68A the grooves define injector holes 76.

Figure 3:
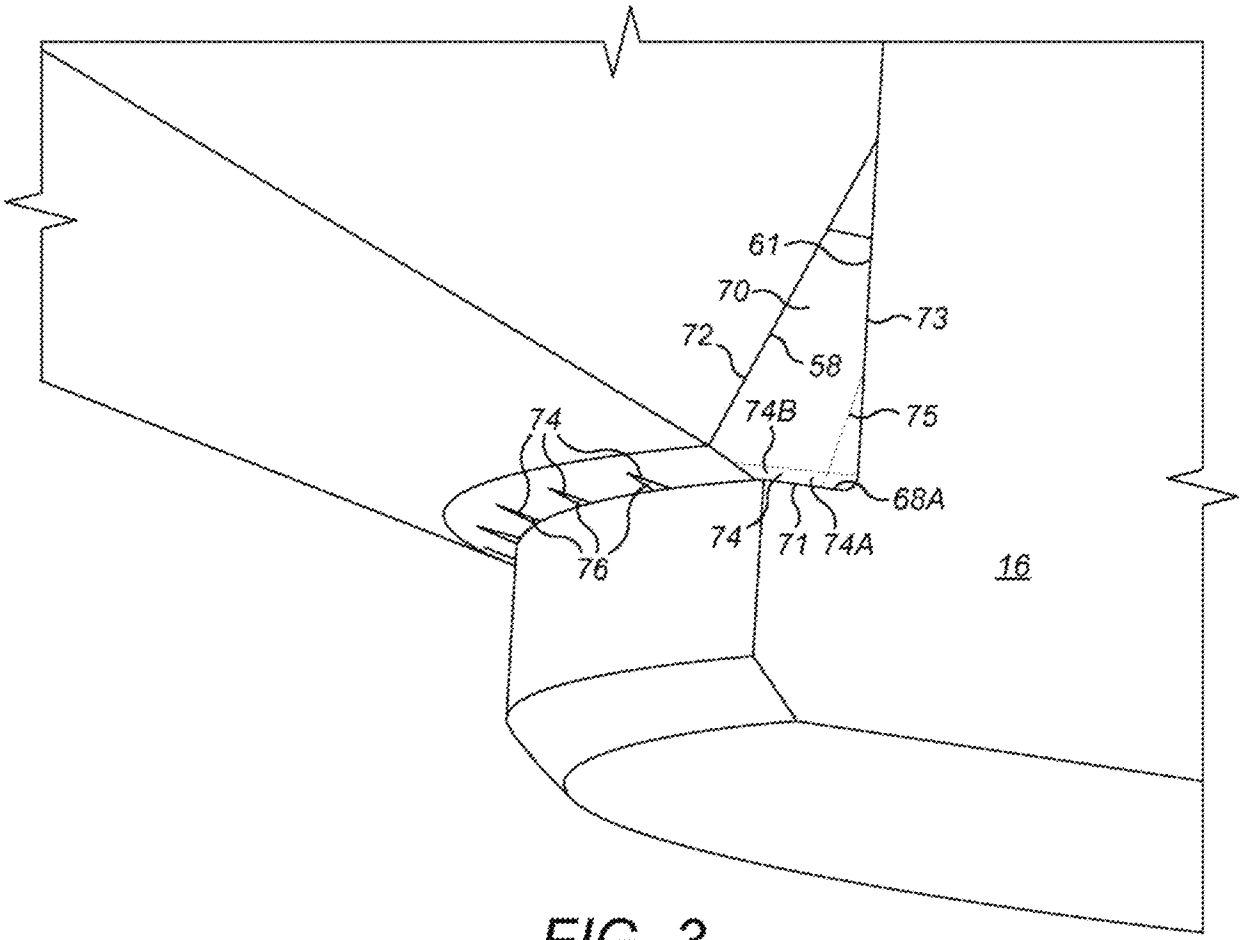
Figure 4:
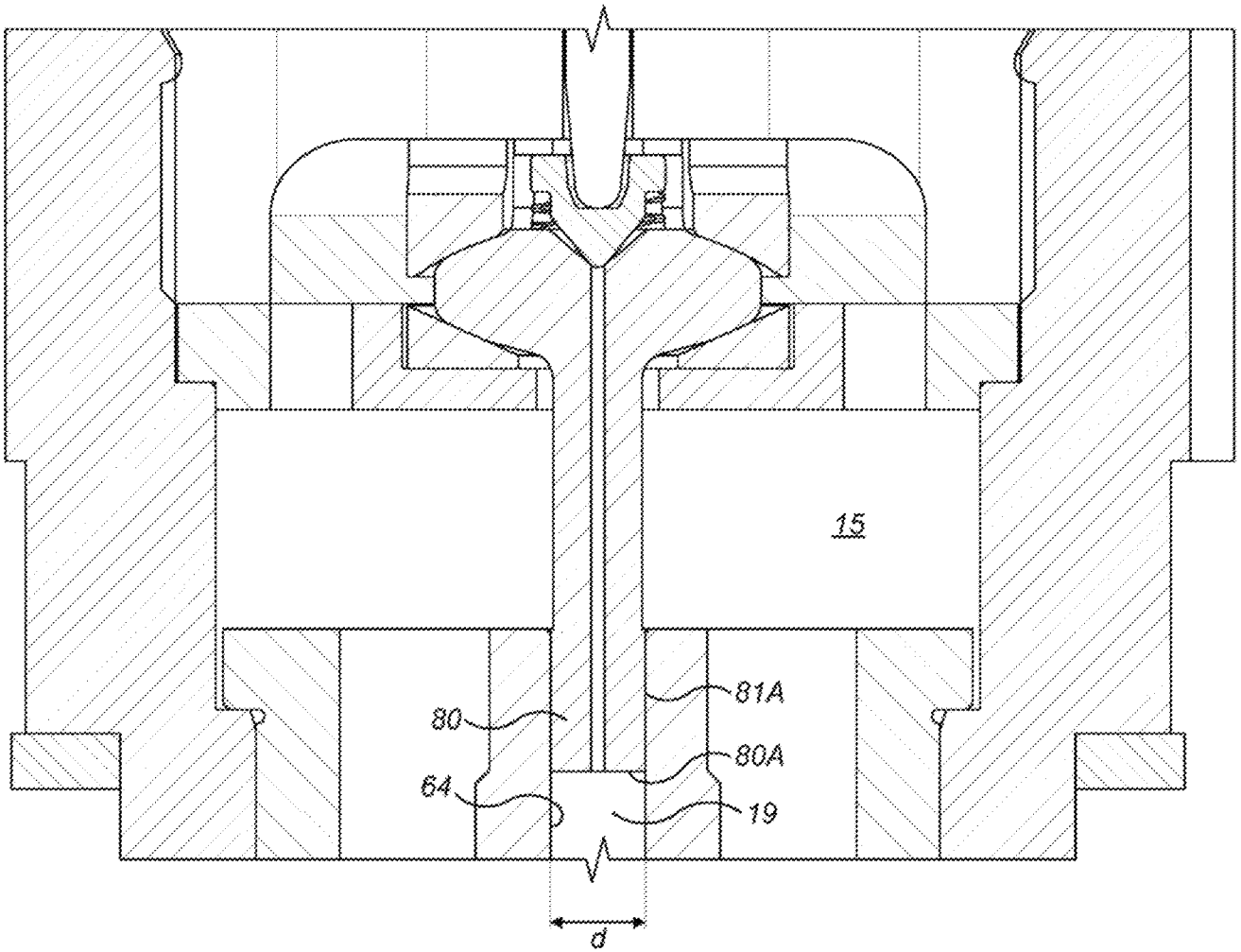

As best seen in FIG. 3, chamfer 58 of the first piston 14 together with stem wall 61 form a wedge shape cross-section and tightening of the nut 62A forces the annular nozzle ring 70 into this "wedge" shape. As such, as an upward force (when viewing FIG. 3) is applied to the nozzle 16 as the nut 62A is tightened, then the second surface 72 of the annular nozzle ring is forced into engagement with the chamfer 58 and the third surface 73 of the annular nozzle ring is forced into engagement with the stem wall 61. Thus, the first surface 71 becomes sealed against the flange surface 68A, the second surface 72 becomes sealed against the chamfer 58 and the third surface 73 becomes sealed against the stem wall 61.

The subassembly defined by the third piston 14, injector nozzle 16, annular nozzle ring 17, check valve subassembly 24A and nut 62A is then inserted into the second part 42 of the body 12 such that the shoulder 55 of the first piston 14 engages the shoulder 48 of the body 12. The plate 106 is then installed in the second part 42 of the body 12 such that shoulder 107 engages shoulder 47 of the second part of the body 12. The second head seat element 112 is then installed in the recess 110. The stem 80 of the second piston 18 is inserted through the bore 115 of the second head seat element 112 and through the central hole 109 of the plate 106 such that end 80A enters bore 63 of the injector nozzle 16. The spring 98, valve element 92 and head seat element 100 are then assembled in place as shown in FIG. 5. The O-ring 45 is installed on the first part 40 and the second part 42 is then attached to the first part 40 via thread 44 such that the plate is clamped at its periphery between the first part 40 and second part 42.

The control volume vent valves 20 are be installed in place as shown in FIG. 1. Rod 121 is installed in place as shown in FIG. 1. Solenoid 120 is installed in place as shown in FIG. 1. The injector apparatus 10 is installed on the cylinder head such that the injector nozzle can communicate with an associated volume 32. Appropriate connections to the supply valve 26, pump 28, and tank T are made.

The solenoid 120 is arranged such that when powered it applies a downward force on rod 121 thereby closing the high pressure valve 99, and when unpowered it does not apply a force to rod 121 thereby allowing the high pressure valve 99 to open.

As shown in the figures, the control volume vent valves 20, the supply valve 26, the check valve 24 and the high pressure valve 99 are all closed.

The injector apparatus thereby defines a control volume 15 and an injector volume 19. The injector volume is defined between the high pressure valve 99 and the check valve, and includes the volume of the passage 85 of the second piston 18, the volume of the bore 63 of the injector nozzle 16 below the end 80A of the second piston 18, and the volume within the central bore 143 of check valve 24.

The control volume is defined as the volume between the high pressure valve 99, the control volume vent valve 20 and the supply valve 26 and it includes the volume within the recess 59 of the first piston 14, the volume within passages 49 and passage 50, the volume above the first piston 14 (which includes the volume between the top of first piston 14 and the plate 106).

Operation of the injector apparatus is as follows:—

Assume the internal combustion engine 38 is running and the piston 34 is ascending within cylinder 36. Assume the internal combustion engine is a four stroke engine and the piston is on its compression stroke.

Assume the control volume vent valve 20, high pressure valve 99, supply valve 26 and check valve 24 are all closed. Assume the control volume 15 and injector volume 19 are primed with fuel.

As the piston 34 ascends the pressure within the combustion chamber increases thereby applying an upward force on the first piston 14. However, because the control volume vent valves 20, supply valve 26 and high pressure valve 99 are all closed the control volume is hydraulically locked, thereby preventing upward movement of the piston 14.

When it is desired to inject fuel, the control volume vent valves are all opened resulting in the control volume 15 no longer being hydraulically locked. The pressure within the combustion chamber acting on piston 14 thereby moves piston 14 upwardly as fluid is vented through the control volume vent valves 20. Upward movement of the piston 14 causes the high pressure volume to decrease since the injector nozzle ascends with the first piston whereas the second piston does not move vertically, rather it remains in place. A decrease in the injector volume causes an increase in the pressure in the injector volume resulting in check valve 20 opening and fuel passing through cross drillings 69 into the annular area defined between chamfer 75 and stem wall 61, and then through grooves 74 into the combustion chamber where it is ignited causing the piston 34 to move downwardly on its expansion stroke. The pressure in the injector volume is defined by the pressure in the combustion chamber and the ratio of the cross-section areas of the cylinder 46 in which the first piston moves and the cross-section area of the bore 64 in which the second piston moves.

In order to stop injection the power to the solenoid 120 is cut thereby allowing the pressure within the injector volume to open the high pressure valve 99. The injector volume 19 is thereby also vented to tank via slots 89, cross drillings 103 and passages 49. Under these circumstances since both the control volume 15 and the injector volume 19 are vented to tank, the check valve will close thereby preventing further injection and the piston 14 will continue to move upwardly as the control volume 15 and injector volume 19 both vent to tank. Upward movement of piston 14 will stop when end surface 59A comes into contact with end surface 106B of plate 106, or when the control valves 20 are closed.

As the piston 34 descends on its expansion stroke the pressure within the combustion chamber will reduce. An exhaust valve or the like will open at an appropriate time thereby allowing the piston to ascend on its exhaust stroke.

At an appropriate time the exhaust valve will close and an inlet valve will open and the piston will descend on its intake stroke. As the piston descends on its intake stroke the pressure within the combustion chamber will be relatively low. The pump 28 can supply fuel at a pump pressure and when the pressure within the combustion chamber falls below the pump pressure the supply valve 26 is opened and the injector volume vent valves 22 are all closed. Fuel flowing into the control volume 15 via passage 50 from the supply valve 26 causes the first piston 14 to descend. As the first piston 14 descends the control volume increases in size as fuel is supplied from pump 28.

As piston 14 descends the injector volume 19 also increases in size and fuel therefore flows from the control volume 15 through the cross drillings 103, through the slots 89 and past valve surface 93 and valve seat 86 (since the high pressure of the valve 99 is open) into the injector volume thereby re-priming the injector volume in anticipation of the next injection event.

In a preferred embodiment, once the first piston has descended to the position shown in FIG. 1 whereby shoulder 55 of the first piston 14 engages shoulder 48 of the body 12 the supply valve 26 is closed.

As the piston ascends on its compression stroke ignition is initiated, as described above by opening the control volume vent valves 20. However, as will be appreciated, because a supply valve 26 has been closed, the control volume 15 does not see the pressure generated by pump 28. As such the difference in pressure across the piston (i.e. the combustion chamber pressure minus the control volume pressure) is greater with supply valve 26 being closed. The pressure across the first piston during injection defines the injection pressure and a greater pressure across the first piston thereby causes a greater injection pressure.

As described above, the supply valve 26 is closed prior to the start of injection. However, the advantage as described above of closing the supply valve 26 (so as to increase the pressure difference across the first piston) is achieved to a lesser extent, by closing the supply valve 26 after the start of injection, but prior to the end of injection.

Injector apparatuses according to the present invention allow for very high injection pressures, and the nozzle needs to be designed to be able to withstand these injection pressures. The high injection pressure is seen in the annulus of wedge shape cross-section defined by the chamfer 75 and stem wall 61 (best seen in FIG. 3). The fuel at the radially inner end 74A of the groove 74 will therefore be at substantially the same pressure as the injector volume 19 pressure. Thus, the lower end (when viewing FIG. 3) of the nozzle adjacent the grooves is exposed to high pressure on its inner diameter but only exposed to (relatively lower) combustion chamber pressure on its outer diameter. Thus, the pressure drop across the annular nozzle ring is significant and the annular nozzle ring has design features enabling it to withstand this large pressure difference. Thus, as described above, as nut 62A is tightened, the annular nozzle ring 70 is forced into the annulus of wedge shape cross-section defined by the chamfer 58 and the stem wall 61.

The chamfer 58 has an included angle of 60° though in further embodiments it may have an included angle of between 20° and 160°, preferably between 40° and 80°, more preferably between 50° and 70°.

In the example shown the first surface 71 and flange surface 68A are both flat, though in further embodiments the first surface 71 and flange surface 68A may be conical thereby injecting fuel sideways and downwardly/upwardly when viewing FIG. 1. The angle of first surface 71 and/or flange surface 68A may be between 10° upwards from horizontal when viewing FIG. 3 and 80° downwards when viewing FIG. 3 (between an included angle of −160° to +20°).

As shown in FIG. 3 the grooves have a triangular cross-section but in further embodiments an appropriate cross-section can be used. As shown in FIG. 3 the cross-section of the groove is constant between the radially inner end 74A and the radially outer end 74B. In further embodiments it may be advantageous to have a cross-section which varies between radially inner end and radially outer end, in particular a cross-section at a radially inner end may be larger than a cross-section at a radially outer end, thereby creating a convergent groove/injector hole.

In the examples above, the convergent injector hole is made by creating a convergent groove on one component (the annular nozzle ring) and then placing the groove proximate another component (the flange surface 68A) to create the convergent injector hole. In further embodiments it is not necessary to use two components to create a convergent injector hole. For example, the injector nozzle 16 and annular nozzle ring 70 could be formed as a single component (for example by an additive manufacturing method, and convergent injector holes could be machined by using a laser micro-milling process, which allows a tapered or convergent shape to be formed in the material.

In view of the high pressures generated by the second piston, the lower wall part 81A needs to be a close sliding fit within bore 46 so as to minimise leakage of fuel from the injector volume 19 to the control volume 15. In one example, the diameter of the lower wall part 81A may be 3.5 mm and the clearance between the lower wall part 81A and the bore 46 may be 1-3 μm on diameter. Thus it is important to ensure the second piston is aligned with the bore 46 of the injector nozzle and remains aligned during injection. To this end, as described above, surface 83 is part spherical and engages against the part spherical surface 102 defined by the head seat element 100. Interaction of these two spherical surfaces allows the head 82 and head seat element 100 to move laterally when viewing FIG. 5 so as to ensure the lower wall part 81A does not jam in the bore 46. Note that when assembled the head 82 is not rigidly clamped between head seat 102 and conical surface 114, rather a clearance is provided to allow the head 82 to float up and down slightly between head seat 102 and conical surface 114. This "float" allows for the above mentioned lateral movement of the head.

The high pressure valve 99 has also been designed to minimise leakage from the injector volume during injection. As mentioned above, head 82 may float slightly laterally when viewing FIG. 5 and high pressure valve 99 has been designed to accommodate this and ensure integrity of the seal between valve surface 93 and valve seat 68. Thus, the abutment 95 is positioned vertically below (when viewing FIG. 5) the guide wall 94 of the valve element 92. When the solenoid is powered the force from rod 121 acting on the abutment 95 is at a point lower than the guide wall 94 which tends to self-align the valve element 92 within the bore 88. Furthermore, the guide wall 94 is part spherical, and as such in the event of any thermal or mechanical distortions of the valve head or cylindrical portion 87 or valve element 92 the valve element can tip slightly within the bore 88 without jamming.

As described above the first surface 71 of the annular nozzle ring 70 includes a series of generally radially orientated grooves. The grooves may be entirely radially orientated, or the grooves may be partially radially orientated and partially circumferentially orientated. The flange surface 68A may also include grooves which are generally radially orientated. As shown in the figures all grooves are formed on the nozzle ring, although in further embodiments all the grooves may be formed on the flange surface 68A, and in further embodiments some grooves may be formed on the flange surface 68A and some grooves may be formed on the nozzle ring.

The grooves are relatively small, in one example the groove may have a width of 60 μm. In another example the groove may have a depth of 60 μm. Any suitable method may be used to create the grooves such as lazer micromelting, wire eroding, spark eroding, stamping, etching and the like.

The groove may have a constant cross-section or may have a variable cross-section. When the groove has a variable cross-section, a cross-section of a radially inner part of the groove may be larger than a cross-section of a radially outer part of the groove, thereby defining a convergent injector hole.

In one example, pump 28 may supply pressure at 10 bar. The pressure in the control volume may reach 100 bar. A pressure in the injector volume may reach 5000 bar.

As described above, the supply valve 26 is opened when the pressure in the combustion chamber falls below the supply pressure of the pump 28, in the example above when the pressure in the internal combustion chamber falls below 10 bar. However, in further embodiments, the supply valve 26 can be opened prior to the pressure in the combustion chamber falling below the pump supply pressure. Under these circumstances the piston 14 would remain "retracted" with end surface 59A of the first piston 14 remaining in contact with end surface 106B of plate 106 until such time as the pressure in the combustion chamber fell below the pump supply pressure whereupon the first piston 14 would start to descend.

As described above there are four vent valves 20 though in further embodiments there may be more or less vent valves, in particular there may be only one vent valve 20. As described above, there is a single supply valve 26, though in further embodiments there may be more than one supply valve 26. In the event that there is more than one supply valve 26, each supply valve may be supplied by a single pump 28 or alternatively may be supplied by its own associated pump 28. As described above, the vent valves 20 as separate valves follow the supply valve 26, though in further embodiments the function of venting the control volume and re-filling the control volume could be carried out by the same valve.

In one example as described above, the pump 28 supplies fuel when the piston descends on its intake stroke. However, supplying fuel to ref-fill the control volume and injector volume is not dependent upon a particular stroke of the engine, rather it depends on the fuel pump pressure and the cylinder pressure which may vary from engine to engine.

As described above, the head seat element 100, head 82 and second head seat element 112 are configured to be able to move laterally when viewing FIG. 5 by a small amount so as to ensure the low wall part 81A of the stem does not jam in the bore wall 64. Whilst head seat surface 102 and surface 83 have been described as being part spherical, in further embodiments it is not necessary to have one or either of the surfaces part spherical, any suitable surface which allows for the above mentioned slight lateral movement would be suitable. Similarly, the shape of conical surface 114 could be varied to any suitable shape. Similarly the shape of surface 84 could be modified to any suitable shape.

With reference to FIGS. 9, 9A, 9B and 9C there is shown an alternative check valve 224 with components that fulfil substantially the same function as those of check valve 24 labelled 100 greater.

Body 230, spring 232, drive element 233, and circlip 234 are identical to those components of check valve 24. The only difference between valve 231 and valve 131 is that valve 231 includes an annular collar 270 and a castellated guide 272. As best seen in FIG. 9B, fuel can flow past the castellated guide 272 when it is situated in the central bore 243. However, the annular collar 270 is a close fit in the central bore 243, as best seen in FIG. 9. In use, the annular collar 270 acts as a piston within bore 243 to prevent dribbling of fuel into the combustion chamber at the end of injection.

Thus, as shown in FIG. 9 the check valve 224 is closed. In order to fully open the check valve 224 the valve 231 must be moved to the position shown in FIG. 9C where the annular collar 270 is no longer received within the bore 243. Once the check valve has achieved the position shown in FIG. 9C injection commences. The castellated guide 272 ensures the valve 231 remains central within the bore.

End of injection is as described above with respect to check valve 24 wherein the valve 231 is returned to the position shown in FIG. 9. However, in doing so it will be appreciated that as the annular collar 270 enters the bore 247 and continues part way up the bore to the position shown in FIG. 9, the annular collar 270 acts as the above mentioned "piston" thereby drawing fluid back from the sac volume into the region between the annular collar 270 and the valve seat/valve surface and hence reduces the pressure in the sac volume and hence preventing or limiting continued dribble of fuel into the combustion chamber after the end of injection.

With reference to FIG. 10, there is shown a schematic view of an alternative injector apparatus. For ease of explanation, only certain components have been shown. Thus, the injector apparatus 310 includes an injector nozzle 316 having a first piston 314 and a second piston 318. In this case the first and second pistons move together. Thus, the first piston 314 moves within bore 346 and the second piston 318 moves within bore 364 of body 390. As will be appreciated, a control volume 315 is defined. Furthermore, an injector volume 319 is defined. The injector apparatus 310 includes check valve 324 (though in further embodiments either of check valves 24 or 224 could be used with injector apparatus 310).

The principal operation of injector apparatus 310 is similar to that of injector apparatus 10. Thus, the control volume and injector volumes are primed by a pump (not shown), valves (not shown) and associated fluid passages.

Combustion chamber pressure acting on the lower surface of the first piston 314 causes it to be forced upwardly when viewing FIG. 10. To start injection the control volume 315 is vented via passages (not shown) and a valve (not shown) to tank. This upward movement of the first piston causes consequential upward movement of the second piston therefore reducing the injector volume and causing injection of fuel through injector holes 376 into the combustion chamber. In order to stop injection, valve 393 (shown schematically) is opened, thereby venting the injector volume 319 via passages 394 and valve 393 to tank. Because, as shown in FIG. 10, the second piston moves relative to the body 390, then the valve 393 is connected to a stationary part of the structure defining the injector volume 319.

As will be appreciated, the fluid in the control volume is the same as the fluid in the injector volume.

As will be appreciated, during injection, the pressure in the injector volume is greater than the pressure in the control volume.

As will be appreciated, during injection, the injector volume is fluidly isolated from the control volume. During injection the injector volume is not in fluid communication with the control volume.

As will be appreciated, during operation, injection can be selectively started, e.g. injection can be started at any time.

As will be appreciated, during operation, injection can be selectively stopped e.g. injection can be stopped at any time.

By being able to selectively start and selectively stop injection, injection timing and duration can be varied as desired between successive injection events.

As will be appreciated, during operation, the pressure and the injector volume is dependent upon the pressure in the associated volume.

What is claimed is:

1. An injector apparatus for injecting a fluid under pressure into an associated volume, the injector apparatus including:

a body with a first cylinder, a first piston moveable within the first cylinder, thereby defining a control volume, a second piston moveable relative to a second cylinder thereby defining an injector volume, an injector nozzle, the first and second pistons being configured such that movement of the first piston in a first direction under action of pressure in the associated volume against the first piston causes a reduction in the control volume and a reduction in the injector volume, the apparatus being configured to cause fluid within the injector volume to be injected under pressure through the nozzle into the associated volume when the first piston moves in the first direction, the injector nozzle including a check valve and a plurality of injector holes, a sac volume being defined between ends of the injector holes proximate the check valve and the check valve, the check valve having a body defining a valve seat and a valve defining a valve surface for engagement with the valve seat to close the check valve, the valve further including a piston movable within a bore of the body configured to draw fluid into the bore from the sac volume upon closing of the check valve.

2. An injector apparatus as defined in claim 1 wherein the valve includes a valve guide configured to centralize the valve in the bore when the valve is open.

3. An injector apparatus for injecting a fluid under pressure into an associated volume, the injector apparatus including:

a body with a first cylinder, a first piston moveable within the first cylinder, thereby defining a control volume, a second piston moveable relative to a second cylinder thereby defining an injector volume, an injector nozzle, the first and second pistons being configured such that movement of the first piston in a first direction under the action of pressure in the associated volume against the first piston causes a reduction in the control volume and a reduction in the injector volume, the apparatus being configured to cause fluid within the injector volume to be injected under pressure through the nozzle into the associated volume when the first piston moves in the first direction, the apparatus including a valve associated with the injector volume to de-pressurize the injector volume and thereby stop injection of fluid into the associated volume.

4. An injector apparatus as defined in claim 3 wherein the valve is in part defined by a valve seat on the second piston.

5. An injector apparatus as defined in claim 4 wherein the second piston includes a through passage and the valve seat is defined at an end of the through passage.

6. An injector apparatus as defined in claim 5 wherein the second piston includes a first end having a cylindrical wall part moveable within the second cylinder and a second end, wherein the through passage extends from the first end to the second end and the second end includes the valve seat.

7. An injector apparatus as defined in claim 4, wherein the valve includes a valve element having a valve surface for selectively engaging the valve seat on the second piston.

8. An injector apparatus as defined in claim 7 wherein the valve surface of the valve element is configured to be selectively biased into engagement with the valve seat on the second piston by an electrically actuated solenoid.

9. An injector apparatus as defined in 7 wherein the valve element includes a guide wall and second piston includes a guide, the guide wall being slideable within the guide.

10. An injector apparatus as defined in claim 9 wherein the guide wall is shaped to allow tilting of the valve element relative to the guide.

11. An injector apparatus as defined in claim 3, wherein the first piston moves in conjunction with the second piston.

12. An injector apparatus as defined in claim 11 wherein the first piston is fixedly attached to the second piston.

13. An injector apparatus as defined in claim 11, wherein the valve includes a valve surface and a valve seat and the first piston moves relative to the valve surface and valve seat.

14. An injector apparatus for injecting a fluid under pressure into an associated volume, the injector apparatus including:

a body with a first cylinder, a first piston moveable within the first cylinder, thereby defining a control volume, a second piston moveable within a second cylinder thereby defining an injector volume, an injector nozzle, the first and second pistons being configured such that movement of the first piston in a first direction under action of pressure in the associated volume against the first piston causes a reduction in the control volume and a reduction in the injector volume, the apparatus being configured to cause fluid within the injector volume to be injected under pressure through the nozzle into the associated volume when the first piston moves in the first direction, wherein a first part of the second piston is moveable within the second cylinder and a second part of the second piston engages a correspondingly-shaped part of the injector apparatus so as to allow alignment of the first part of the second piston with the second cylinder when movement of the first piston in the first direction causes a reduction in the injector volume.

15. An injector apparatus as defined in claim 14 wherein the second part is generally part spherical.

16. An injector apparatus as defined in claim 14, wherein said correspondingly shaped part of the injector apparatus can move relative to the body.

17. An injector apparatus as defined in claim 14, wherein the second part has a larger diameter than the first part.

18. An injector apparatus as defined in claim 14, wherein the second part engages a further correspondingly shaped part of the injector apparatus opposite said correspondingly shaped part of the injector apparatus.

19. An injector apparatus as defined in claim 18, wherein said second part is generally part spherical to engage said further correspondingly shaped part of the injector apparatus.

20. An injector apparatus as defined in claim 18, wherein said further correspondingly shaped part of the injector apparatus is moveable relative to the body.

* * * * *